US007469666B2

(12) United States Patent
Martinsson et al.

(10) Patent No.: US 7,469,666 B2
(45) Date of Patent: Dec. 30, 2008

(54) TWO-STROKE ENGINE

(75) Inventors: Par Martinsson, Jonkoping (SE); Mikael Bergman, Banhergd (SE); Reine Gustafsson, Jonkoping (SE)

(73) Assignee: Husqvarna AB, Huskvarna (SE)

( * ) Notice: Subject to any disclaimer, the term of this patent is extended or adjusted under 35 U.S.C. 154(b) by 0 days.

(21) Appl. No.: 10/572,666

(22) PCT Filed: Sep. 25, 2003

(86) PCT No.: PCT/SE03/01491

§ 371 (c)(1),
(2), (4) Date: Dec. 4, 2006

(87) PCT Pub. No.: WO2005/028828

PCT Pub. Date: Mar. 31, 2005

(65) Prior Publication Data

US 2007/0079779 A1 Apr. 12, 2007

(51) Int. Cl.
*F02B 25/00* (2006.01)

(52) U.S. Cl. ..... 123/73 PP; 123/73 R

(58) Field of Classification Search ..... 123/73 R, 123/73 PP; 181/230
See application file for complete search history.

(56) References Cited

U.S. PATENT DOCUMENTS 4,220,625 A * 9/1980 Toh et al. ..... 422/180
5,866,859 A * 2/1999 Karlsson et al. ..... 181/230
5,996,732 A * 12/1999 Burger et al. ..... 181/230
6,298,811 B1 10/2001 Sawada et al.
2002/0043227 A1* 4/2002 Carlsson et al. ..... 123/73 PP
2003/0165414 A1* 9/2003 Galligan et al. ..... 423/213.2

FOREIGN PATENT DOCUMENTS

JP 2002-332846 11/2002
WO WO 01/51785 A1 7/2001
WO WO 02/061245 A1 8/2002

* cited by examiner

*Primary Examiner*—Noah Kamen
(74) *Attorney, Agent, or Firm*—Pearne & Gordon LLP

(57) ABSTRACT

A crankcase scavenged two-stroke engine (1) comprises a cylinder (15) including scavenging ports (31, 31') and at least one exhaust port, a piston (13), a connecting rod (17), a crankshaft (18) and a generally sealed crankcase (16). The crankcase inducts a fuel/air mixture and is connected to the scavenging ports (31, 31') by means of transfer ducts (3, 3') which, as the piston (13) is travelling from a lower position towards a higher position, are inducting pure air let in from connecting ports (8, 8') near the scavenging ports (31, 31') in the cylinder (15). The transfer duct (3, 3') volume is less than 20% of a volume swept by the piston (13) during an entire revolution of the crankshaft (18). Recesses (10, 10') are formed in an outer periphery of the piston (13), said recesses (10, 10') co-operating with the connecting ports (8, 8') in the cylinder wall for controlling the filling of the transfer ducts (3, 3') with air. An inlet tube (22) in the cylinder wall supplies the air/fuel mixture, said inlet tube (22) being connected to the crankcase (16) and covered by the piston (13) as the piston (13) is in the lower position, and open to the crankcase (16) as the piston (13) is in the higher position.

5 Claims, 1 Drawing Sheet

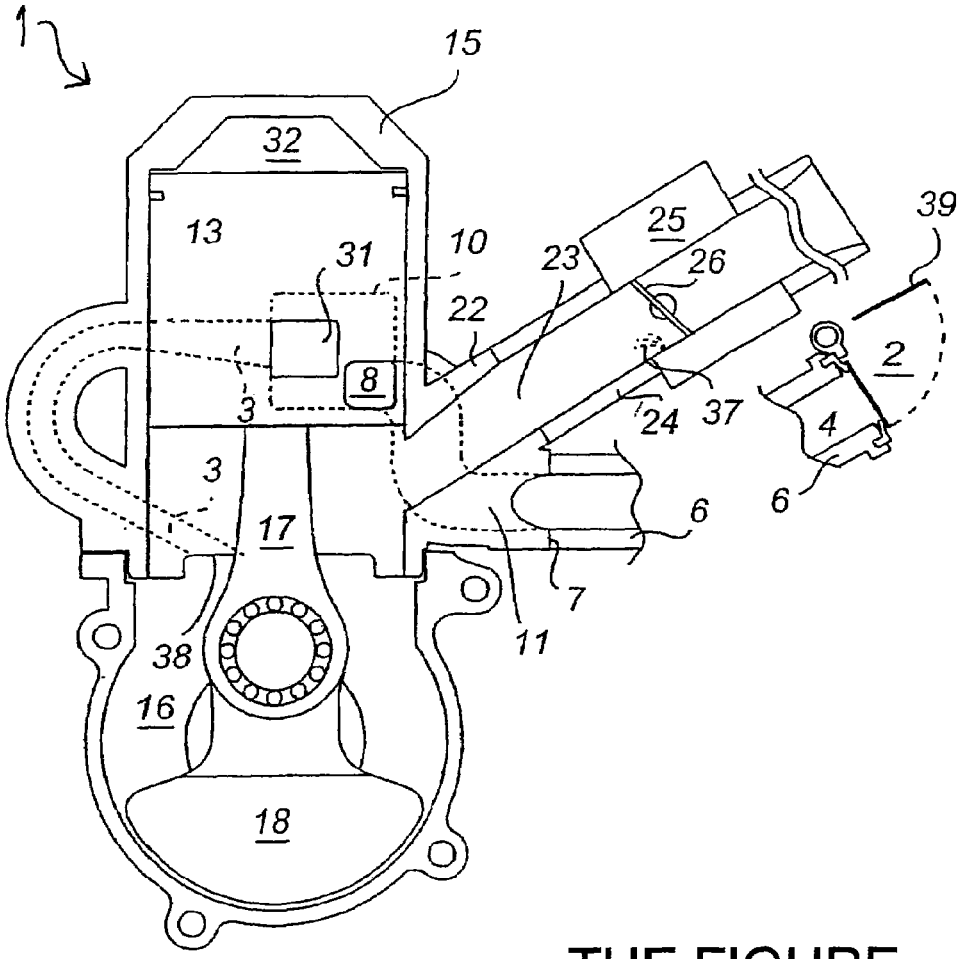
THE FIGURE

TWO-STROKE ENGINE

FIELD OF THE INVENTION

The present invention relates to a crankcase scavenged two-stroke engine comprising a cylinder including scavenging ports and at least one exhaust port, a piston, a connecting rod, a crankshaft and a generally sealed crankcase. The crankcase inducts a fuel/air mixture and is connected to the scavenging ports by means of transfer ducts. As the piston is travelling from a lower position towards a higher position, the transfer ducts are inducting pure air let in from connecting ports near the scavenging ports in the cylinder.

The present invention further relates to a scavenging method for a crankcase scavenged two-stroke engine of the above-mentioned type.

BACKGROUND OF THE INVENTION small, carburetted two-stroke engines are mainly used for hand-held tools, like e.g. chain saws, weed cutters, trimmers, lawn mowers, etc. The main reasons for using two-stroke engines for such tools/machines are that they are cost effective and that they have a high power-to-weight ratio. A further advantage of the two-stroke engine compared to other engine options is that the mechanical design is very simple, principally only containing three moving parts (the piston, the connecting rod and the crankshaft).

The major problem with small, crankcase scavenged, carburetted two-stroke engines is the emission level of unburned hydrocarbons (uHC) and carbon monoxide (CO). For the past decade, legislation and authorities have demanded a decreased level of these emissions. Legislation also requires low amounts of nitric oxides ($NO_x$), but due to the general function of two-stroke engines, the emission of $NO_x$ is inherently low. In the following, the formation processes of the above-mentioned emissions will be briefly explained.

Carbon monoxide is formed when a hydrocarbon, such as gasoline, Liquid Petroleum Gas (LPG), diesel fuel, or any compound containing coal, is combusted in presence of too small amounts of oxygen to complete the combustion to carbon dioxide ($CO_2$). The only way of decreasing the emission of CO is to lean the combustion, i.e. to mix the coal containing fuel with more oxygen (i.e. in most cases more air). Leaning out the fuel/air mixture has however some severe drawbacks regarding engine cooling, lubrication and engine behaviour.

$NO_x$ is formed whenever a gas containing nitrogen and oxygen is heated, e.g. in a combustion chamber of an internal combustion engine. The $NO_x$ formation is dependent on the temperature, the time the gas mixture is heated, the nitrogen and oxygen concentration, and the temperature decrease rate. As mentioned earlier, $NO_x$ formation is not a severe problem in a two-stroke engine. The reasons for this are;

- The temperature in the combustion chamber does not reach high levels, due to fuel rich combustion and excessive dilution of the combustible fuel/air mixture with exhaust gases.
- Due to the fuel rich mixture, virtually all oxygen present in the combustion chamber prior to combustion is consumed during the combustion. This leaves no oxygen for the formation of $NO_x$.

The formation of unburned hydrocarbon emissions (uHC) is a little bit more complicated than the formation of the $NO_x$ and CO emissions:

- One main source for uHC emissions is the clearance volume over the piston ring pack, since unburned air/fuel mixture in pressed down into this volume and hence escapes combustion.
- Wall quenching is another major contributor to uHC emissions. Wall quenching means that the combustion flame is not able to travel all the way to a combustion chamber wall, leaving an unburned zone close to the combustion chamber walls.
- Incomplete combustion is a third source of uHC emissions. Incomplete combustion mainly occurs when the fuel air mixture is too diluted with an excessive air or exhaust gas amount to burn.
- Short-circuiting is the main source of uHC emissions from two-stroke engines, and occurs since the exhaust port is open during the scavenging of the cylinder with unburned fuel/air mixture.

In order to decrease the emissions of uHC from two-strokes engines, many measures have been taken in the past. Mostly, those efforts have been directed towards redesigning the so-called transfer channels, i.e. the channels from which the unburned air/fuel mixture enter the cylinder; different transfer channel designs give different scavenging flow patterns in the cylinder.

For the last decades, an old scavenging method called "air-head" scavenging has gained the interest from scientists and engine researchers as a means of reducing the emissions of uHC from two-stroke engines. The basic idea behind the air-head engine is that the first air-fuel mixture that enters the cylinder through the transfer channels is the most likely to short-circuit. Hence, an air-head scavenging system starts by letting pure air flow through the transfer channels, which increases the probability that pure air is short-circuited.

As mentioned, the idea behind the air-head scavenging is not new. In fact, Dugald Clerk, the man who is generally recognised as the inventor of the two-stroke engine, described an air-head system as early as 1881 (see GB-B-1089), but he did not use he air-head scavenging as a means for reducing the short-circuiting losses, rather as a means for avoiding premature ignition of the fresh charge, due to contact with the hot exhaust gases. More recent development has shown that there is no or little risk that uncompressed fresh air/fuel mixture ignites on hot combustion gases. Further, Clerk describes use of an air-head scavenging for a dual piston engine, with a uniflow type scavenging system of the power cylinder.

The engine described in GB 1089 has very little in common with the engine according to the present invention. The GB 1089 engine has e.g. two different piston/cylinder arrangements. One of the cylinders has as its only task to provide the other cylinder with the scavenging action for the new charge, whereas the other cylinder is the power cylinder, in which the combustion takes place.

A slightly more recent publication (U.S. Pat. No. 968,200, from 1910) describes an air-head scavenging for a crankcase scavenged two-stroke engine with a fairly complicated design. The piston is namely divided into two portions, wherein the power cylinder portion has a considerably smaller diameter than the scavenging portion of the piston. This means that the scavenging volume will be much larger than the cylinder volume, making short-circuiting of unburned fuel/air mixture unavoidable. Hence, the main reason for the air-head scavenging of U.S. Pat. No. 968,200 was probably to scavenge the cylinder from exhaust gases prior to letting in unburned fuel/air mixture. According to U.S. Pat. No. 968,200, a piston controlled ducting system is used to fill the crankcase with fuel/air mixture and the single transfer channel with pure air. In this way, air only will enter the cylinder during the initial phase of the scavenging. In order to separate the pure air from the fuel/air mixture, the transfer channel of U.S. Pat. No. 968,200 is very long, and contains a spiral path, in order to increase the flow-path length.

Further, the design according to U.S. Pat. No. 968,200 uses cross-scavenging, i.e. the transfer channel is connected to the cylinder at a position opposite the exhaust port. Excessive short-circuiting is avoided by means of a deflector on the piston top.

F. W Lanchester and R. H. Pearsall (The institution of automobile engineers, "An investigation of certain aspects of the two-stroke engine for automobile vehicles", pp 55-62 February, 1922) describe a further arrangement for an air-head scavenged two-stroke engine. The concept described in that publication also uses very large transfer channels, in order to avoid mixing of the pure air with the fuel/air mixture in the crankcase. Lanchester and Pearsall even describe the use of a honeycomb structure in the transfer channel in order to reduce the mixing of the pure air with the fuel/air mixture in the crankcase. Further, the engine described in the above publication uses a cross scavenging similar to the type described above with reference to U.S. Pat. No. 968,200.

SAE paper 980761 (Society of automotive engineers, Inc, 1998) describes an air-head engine with reed valve (e.g. one-way valves) control, both for the incoming air-head air and for the air-fuel mixture. The scavenging pattern of the cylinder according to SAE 980761 is a so-called loop-scavenging, i.e. the scavenging flow from the transfer channels is directed towards a point in the cylinder on the side opposite the exhaust port.

WO-A-00/40843 describes a modified air-head scavenging, wherein two transfer channels close to the exhaust port scavenge the cylinder with pure air during the entire scavenging phase, and two transfer channels remote from the exhaust port scavenge the cylinder with a fuel-rich fuel/air mixture. Reed valves are used to control the airflow from the air scavenging transfer channels, which have a very large internal volume.

WO-A-99/18338 describes an air head engine with reed valve control of the air-head air flow and the fuel/air mixture flow. The transfer channels of this engine are also very large, actually it is stated on page 2, lines 34-37 that "the total volume of the scavenging hole and scavenging channel is set so as to be greater than 20% of the stroke volume".

There are severe problems with the prior art designs:

In all prior art designs, the length of the transfer channels is very large. This leads to a lower high-speed power than is the case for shorter transfer channels. Until now, long channels have been regarded as necessary in order to get acceptable function of air-head engines. The long transfer channels also lead to a larger volume being connected to the crankcase, leading to a lower crankcase compression ratio, which in turn leads to a lower scavenging efficiency. Further, long and bulky channels add to the total size and volume of the engine.

The above-described designs comprising loop scavenging all utilise reed valves as the control means for the airflow to the crankcase and to the transfer channels. This is an expensive and complicated way of controlling the airflow.

A further problem with the prior art designs is related to the characteristics of the carburetor. In order to get an acceptable idling running of the engine, the carburetor is usually set to provide a very fuel-rich mixture. As mentioned above, fuel-rich mixtures lead to excessive amounts of CO emissions. CO emissions are very harmful for all animals, and are of course a major problem for handheld tools that usually are used in the vicinity of the respiratory organs of a user. For present air-head engines, which mainly short-circuit air, the fuel-air ratio in the cylinder stays very fuel rich, even at high load. Obviously, this contributes to the CO emission levels.

SUMMARY OF THE INVENTION

The present invention solves these and other problems by providing a crankcase scavenged two-stroke engine in which the transfer duct volume is less than 20% of a volume swept by the piston during an entire revolution of the crankshaft. Further, the engine is provided with recesses formed in an outer periphery of the piston, said recesses co-operating with the connecting ports in the cylinder wall for controlling the filling of the transfer ducts with air, and an inlet tube in the cylinder wall for supplying the air/fuel mixture. The inlet tube is connected to the crankcase and covered by the piston as the piston is in the lower position, and open to the crankcase as the piston is in the higher position.

Furthermore, the above and other problems are solved by a scavenging method in which some of the air inducted through the transfer ducts is mixed with the fuel/air mixture in the crankcase.

BRIEF DESCRIPTION OF THE DRAWING

In the following, the invention will be explained in greater detail with reference to the only drawing, wherein the FIGURE is a schematic view of a two-stroke engine according to the invention.

DESCRIPTION OF EMBODIMENTS

In this description, like reference numerals of which one is denoted with implies that there are identical components on opposite sides of the engine. Due to clarity reasons, only one of such components is shown in the drawing In the FIGURE, a carburetted two-stroke engine 1 utilising an "air-head" scavenging system is shown. The engine comprises a cylinder 15 and a piston 13 being connected to a crankshaft 18 by means of a connecting rod 17, which piston in co-operation with the cylinder defines a combustion chamber 32. The piston is also equipped with flow paths 10, 10', in the form of recesses. The function of these recesses will be described in the following. Further, the engine comprises an inlet 22 connected to a carburettor, or fuel dosage means, 37 by an inlet duct 23. The piston, the lower end of the cylinder and a crankcase define a generally sealed crankcase volume 16, into which the inlet 22 opens. The crankcase is connected to the cylinder by means of transfer ducts 3, 3', opening in transfer ports 31, 31'.

Further, the engine according to the invention includes an air inlet 2, connected to connecting ports 8, 8', opening on a cylinder wall, by means of connecting ducts 6, 6'

Still further, the engine according to the invention comprises an exhaust port (not shown) located in the cylinder wall. The exhaust port is connected to some kind of muffler (not shown), for noise reduction. In some cases, it could be advantageous if the muffler comprises catalysing means for reducing exhaust emissions. This topic will be more thoroughly described in the following.

The engine according to the invention also includes an air inlet 2 that is connected to the connecting ports 8, 8', opening on the cylinder wall.

During operation of the engine, the crankshaft 18 will rotate, clockwise or counter-clockwise, depending on where it is used. The rotative movement of the crankshaft 18 will force the piston 13 to move up and down by means of the connecting rod 17 in the cylinder, in a path restricted by the cylinder walls. As mentioned earlier, the connecting ports 8, 8', the inlet port 22, the transfer ports 31, 31' and the exhaust port all open in the cylinder wall, which means that they will be opened or closed depending on whether they are covered by the piston or not.

In the following, the function of the engine will be described under reference to the above mentioned components.

When the piston is at its highest position (generally referred to as the Top Dead Centre, TDC), the exhaust port is closed by the piston wall, and has no connection to the interior volumes of the engine. The crankcase is filled with an unburned mixture of fuel and air, partly drawn in from the carburettor through the inlet port 22, and partly (applies for the air only) through the transfer ducts 3, 3'. The air coming in through the transfer ducts is drawn for the air inlet 2, through the connecting ports 8, 8' through the flow paths 10, 10' in the piston walls, finally entering the transfer ports 31, 31' and hence the transfer ducts 3, 3'.

As the piston moves downwards (helped by the force exerted by hot combustion gases in the combustion chamber 32), the piston will close the connecting ports 8, 8', the transfer ports 31, 31' (due to the flow paths 10, 10' moving past the connecting ports and the transfer ports), and the inlet port 22. This leads to a pressure increase in the crankcase as the piston moves downward, since the free crankcase volume 16 decreases. Shortly after the inlet port, the transfer ports and the connecting ports are closed by the piston, whereas the exhaust port will open. The opening of the exhaust port allows the exhaust gases in the cylinder to leave the cylinder and enter the atmosphere, also leaving room for an unburned charge to enter the cylinder.

When the piston 13 has travelled even further downwards, it will uncover the transfer ports 31, 31', which are in fluid communication with the crankcase 16 by means of the transfer ducts 3, 3'. Due to the higher pressure in the crankcase, the fuel/air mixture in the crankcase will start to flow through the transfer ducts 3, 3' into the cylinder 32, and scavenge the cylinder from exhaust gases. A major problem is however that the exhaust port is open as the fuel/air mixture enters the cylinder; it is inevitable that a part of the fuel/air mixture escapes the cylinder through the exhaust port. In the engine according to the invention, this problem is however significantly reduced, since the first portion of the fuel/air mixture in the cylinder actually is pure air, since air only is let in through the connecting port 8, 8' through the flow paths 10, 10', into the transfer ducts 3, 3'. It is probable that the first portion of the gas that enters the cylinder is most likely to escape through the exhaust port. Since the first portion of the fuel/air mixture entering the cylinder is pure air, this air has a higher probability of escaping the cylinder, compared to the fuel/air mixture entering the cylinder at a later stage.

After, or during, the scavenging of the cylinder with fuel/air mixture, the piston will reach its lowest position, which is often referred to as the Bottom Dead Centre, BDC. After the BDC, the piston starts to travel upwards, due to the inertial force of the system (very often, a flywheel increasing the inertial force is connected to the crankshaft). As the piston is travelling upwards, it closes the transfer ports and the exhaust ports. This leads to the fuel/air mixture in the cylinder being compressed and the remaining fuel-air mixture in the crankcase being decompressed. The decompression of the crankcase volume leads to a lower pressure. As the piston continues upwards, the inlet port 22 and the flow path defined by the air inlet 2, the connecting ports 8, 8', the flow paths 10, 10' in the piston walls, the transfer ports 31, 31' and the transfer ducts 3, 3' are opened to the crankcase volume 16. Due to the lower pressure in the crankcase, fuel/air mixture and pure air will be inducted into the crankcase from the inlet port 22 and from the transfer ducts 3, 3', respectively.

As the piston reaches a position close to the Top Dead Centre, TDC, the fuel air mixture will be ignited, preferably by means of a spark plug. There are however other possible options for the ignition, e.g. HCCI (Homogeneous Charge Compression Ignition), glow plugs or the like.

After the ignition, the process starts all over again.

According to the invention, the volume of the transfer ducts 3, 3', from the transfer ports 31, 31' to the crankcase, should be less than 20% of the volume swept by the piston. This means that a certain amount of pure air will be let into the crankcase through he transfer ducts 3, 3' and mix with the fuel/air mixture in the crankcase. This is in contradiction to the common knowledge of the industry; as can be seen in the prior art chapter, the main goal has always been to make the transfer duct volume large enough to host the entire volume of pure air let in from the transfer ports 31, 31' into the transfer ducts 3, 3'.

The embodiment according to the invention has a number of advantages compared to the prior art:

The high-speed power is considerably improved by using transfer ducts with comparatively small volume.

After each fuel/air mixture scavenging of the cylinder, the transfer duct walls will be wetted by fuel and oil droplets (in case the engine is "petroil" lubricated, see below). In prior art designs, this fuel and oil will be retained in the "pure air" in the part of the transfer duct that is located close to the crankcase. This means that actually it is no advantage to have a larger transfer duct volume; the last "pure air" that is forced into the cylinder will still be polluted with fuel and oil.

It is preferable that the two-stroke engine according to the present invention is "petroil" lubricated. Petroil lubrication means that lubricating oil is added to the gasoline. Petroil is a very simple, safe and low-cost solution to the lubrication problem. The invention is however not limited to this type of lubrication. For example, it could be useful to have an oil pressure based lubrication system, or an oil mist system The scavenging system according to the invention is a so-called "loop-scavenging" (or Schnürle) design. Loop-scavenging means that the transfer channels are designed for directing the flow of fuel/air mixture away from the exhaust port in order to avoid short-circuiting. Loop scavenging is the most common type of scavenging in small, single cylinder engines, but is unfortunately space inefficient for multi-cylinder engines.

It is crucial to the invention that the piston controls the ports (inlet port, connection ports, and transfer ports). In other embodiments the ports could be controlled by means of separate valve constructions, e.g. reed valves, but these solutions are complicated and costly.

It is very beneficial to equip the engine according to the invention with an oxidising catalyst. In "standard" two-stroke engines, i.e. two-stroke engines without the scavenging system according to the invention, there is a major problem connected to generation of excessive amounts of heat in the catalyst, due to the short-circuiting of fuel/air mixture. This problem is reduced significantly for an engine according to the invention, since the short-circuited gas is "diluted" with air.

As mentioned, it is crucial to the invention that the transfer duct volume is less than 20% of the volume swept by the piston, which leads to a part of the air inducted into the transfer ducts mixing with the fuel/air mixture in the crankcase. This is beneficial to the catalyst operation, since the air/fuel ratio in the crankcase will be slightly diluted with air, from a very fuel-rich level. As is well known by people skilled in the art of combustion, fuel rich mixtures lead to high emission levels of unburned hydrocarbons (uHC) and carbon monoxide (CO). On prior art engines using similar air-head scavenging techniques, but with larger transfer ducts, the air inducted through the transfer ducts does not mix with the fuel/air mixture in the crankcase. Hence, they do not benefit from this effect.

The catalyst could be of an ordinary design, comprising a metal or ceramic substrate coated with a primary wash-coat and a secondary noble metal coating. The noble metal coating could e.g. consist of Palladium (Pl), Rhodium (Rh), Platinum (Pt), or mixtures thereof. The substrate on which the wash-coat and the noble metals are coated can be of various shapes and designs. One preferred design is a wind of metal wires, wherein the wires are coated with the wash-coat and the noble metal(s). This type of catalyst is often referred to as a "wire mesh catalyst". One other preferred design is a spiral wound sheet metal substrate, wherein two sheet metal stripes, of which one is corrugated, are wound in a spiral pattern, forming channel between the corrugated and the flat metal sheet. To get the catalytic effect, the sheet metal stripes are coated with wash-coat and noble metals.

There is a further design possibility or the catalyst, namely a single plate of sheet metal placed in the centre of the muffler. The exhaust flow should be directed towards the sheet metal plate, which should be coated with the catalytic material.

In the above description of embodiments, it has been presumed that the fuelling of the engine has been accomplished by means of a carburettor. The invention is however applicable in combination with other fuelling devices, e.g. injection systems.

The invention claimed is:

1. A crankcase scavenged two-stroke engine (1) comprising a cylinder (15) including scavenging ports (31, 31') and at least one exhaust port, a piston (13), a connecting rod (17), a crankshaft (18) and a generally sealed crankcase (16) for inducting a fuel/air mixture from a fuel dosage means (37), the crankcase (16) being connected to the scavenging ports (31, 31') by means of transfer ducts (3, 3') for inducting pure air let in from connecting ports (8, 8') near the scavenging ports (31, 31') in the cylinder (15), the transfer duct (3, 3') volume being less than 20% of a volume swept by the piston (13) during an entire revolution of the crankshaft (18), recesses (10, 10') formed in an outer periphery of the piston (13), said recesses (10, 10') co-operating with the connecting ports (8, 8') in the cylinder wall for controlling the filling of the transfer ducts (3, 3') with air, an inlet tube (22) formed in the cylinder wall for supplying the air/fuel mixture, said inlet tube (22) being connected to the crankcase (16) and covered by the piston (13) as the piston (13) is in the lower position, and open to the crankcase (16) as the piston (13) is in the higher position.

2. The two-stroke engine according to claim 1, wherein the fuel dosage means (37) is a carburetor.

3. The two-stroke engine according to claim 1, wherein the fuel dosage means (37) is an injection system.

4. A scavenging method for a crankcase scavenged two-stroke engine (1) comprising a cylinder (15) including scavenging ports (31, 31') and at least one exhaust port, a piston (13), a connecting rod (17), a crankshaft (18) and a generally sealed crankcase (16) inducting a fuel/air mixture , the crankcase (16) being connected to the scavenging ports (31, 31') by means of transfer ducts (3, 3') which are inducting pure air let in from connecting ports (8, 8') near the scavenging ports (31, 31') in the cylinder (15), comprising the following steps:

inducting the generally pure air into the transfer ducts (3, 3') by means of recesses (10, 10') formed in the piston wall, said recesses (10, 10') co-acting with the connecting ports (8, 8') in the cylinder wall to control the induction of air into the transfer ducts (3, 3'), inducting the fuel/air mixture through an inlet tube (22) in the cylinder wall that is covered by the piston (3) as the piston (3) is in a lower position and is open to the crankcase(16) as the piston (3) is in a higher position, wherein the transfer duct (3, 3') volume versus the volume of the inducted pure air is such that an amount of the induced pure air will mix with the fuel/air mixture in the crankcase (16).

5. The method according to claim 4, wherein the transfer duct (3, 3') volume is less than 20% of the volume swept by the piston (13) during a full revolution of the crankshaft (18).

* * * * *